7/9/85 OR 4,528,454

United States Patent [19]

Baatz et al.

[11] Patent Number: 4,528,454

[45] **Date of Patent: * Jul. 9, 1985**

[54] RADIATION-SHIELDING TRANSPORT AND STORAGE CONTAINER

[75] Inventors: Henning Baatz; Dieter Ritsscher, both of Essen; Jürgen Wriegt, Heiligenhaus, all of Fed. Rep. of Germany

[73] Assignee: GNS Gesellschaft fur Nuklear-Service mbH, Essen, Fed. Rep. of Germany

[ * ] Notice: The portion of the term of this patent subsequent to Jun. 16, 1998 has been disclaimed.

[21] Appl. No.: 243,627

[22] Filed: Mar. 13, 1981

[30] Foreign Application Priority Data

Mar. 19, 1980 [DE] Fed. Rep. of Germany ..... 3010493

[51] Int. Cl.[3] ..... G21F 5/00

[52] U.S. Cl. ..... 250/506.1

[58] Field of Search ..... 250/506.1, 507.1, 515.1; 376/272

[56] References Cited

U.S. PATENT DOCUMENTS

| | | | |
|---|---|---|---|
| 3,414,727 | 12/1968 | Bonilla | 250/506.1 |
| 3,982,134 | 9/1976 | Housholder et al. | 250/506.1 |
| 4,197,467 | 4/1980 | Williams | 250/506.1 |
| 4,234,798 | 11/1980 | Baatz et al. | 250/506.1 |
| 4,274,007 | 6/1981 | Baatz et al. | 250/506.1 |

FOREIGN PATENT DOCUMENTS

| | | |
|---|---|---|
| 7825615 | 1/1979 | Fed. Rep. of Germany . |
| 2837631 | 3/1980 | Fed. Rep. of Germany . |
| 7930459 | 3/1980 | Fed. Rep. of Germany . |

*Primary Examiner*—Alfred E. Smith
*Assistant Examiner*—Carolyn E. Fields
*Attorney, Agent, or Firm*—Karl F. Ross; Herbert Dubno

[57] ABSTRACT

A container for the storage and transportation of radioactive material comprising an elongated vessel adapted to receive the material and having a wall thickness and composition attenuating radioactive transmission therefrom, the vessel has an open end formed with an annular thickened portion defining a mouth communicating with the interior of the vessel; a radiation-shielding cover received in the mouth and having a plug-forming portion juxtaposed with a complimentary seat-forming portion of the vessel at the mouth, and a flange extending outwardly from the plug-forming portion, the vessel is provided with a wall bore communicating at one end with the interior of the vessel and terminating at its opposite end within the outline of the radiation-shielding cover, the radiation-shielding cover is provided with a connecting bore registering with the wall bore; an obturating element received in the connecting bore and adapted to block the wall bore; and a further cover secured directly to the vessel outwardly of the radiation-shielding cover and overlying the wall bore and the radiation-shielding cover.

4 Claims, 3 Drawing Figures

RADIATION-SHIELDING TRANSPORT AND STORAGE CONTAINER

CROSS REFERENCE TO RELATED APPLICATIONS

The present application is related to commonly assigned copending application Ser. No. 120,108 filed Feb. 8, 1980 (now U.S. Pat. No. 4,274,007 of June 16, 1981 and Ser. No. 966,951 filed Dec. 6, 1978 (now U.S. Pat. No. 4,278,892 of July 14, 1981 and making reference to then-pending applications Ser. No. 940,856 of Sept. 8, 1978, (now U.S. Pat. No. 4,272,683 of June 9, 1981, Ser. No. 940,098 (now U.S. Pat. No. 4,234,798), and Ser. No. 107,276 of Sept. 26, 1979 (now U.S. Pat. No. 4,288,698 of Sept. 8, 1981. Reference may also be had to U.S. Pat. Nos. 4,229,316 and 4,235,739 issued on still earlier applications commonly owned herewith.

For the construction of the vessel and as to radiation-shielding properties thereof and the use of such vessels, these prior art applications and patents are hereby incorporated by reference in their entirety and it is noted that the prior art known to applicants to be the most relevant is the art of record in said applications.

FIELD OF THE INVENTION

As is pointed out in the aforementioned copending applications, it is known to provide for the transport and storage of radioactive wastes, containers or vessels of a radiation-shielding material and which may be provided with channels or compartments to contain radiation-blocking or radiation-attenuating materials, and with ribs or the like to promote heat exchange with ambient air. Radioactive material can be placed in such containers and sealed by cover arrangements of which the most pertinent is that found in application Ser. No. 120,128, in which it is pointed out that an effective closure for the vessel can be provided by forming the mouth of the vessel with a seat receiving the plug-type inner cover having a frustoconical portion and a cylindrical portion fitting into correspondingly shaped parts of the seat and sealed relative to the latter with elastomeric seals, generally O-rings. Above this inner cover an outer cover was provided which extended beyond the outline of the inner cover and was secured to the vessel.

The container vessel, which is formed at its upper and lower ends with thickened portions for reinforcement and stability, generally in the form of annular beads or enlargements, can be composed of cast iron and especially spherulitic (nodular) cast iron, can be used for the storage and disposal of radioactive materials of various types, especially irradiated nuclear fuel elements upon their removal from the core of a nuclear reactor.

As can be seen from German patent document No. 28 37 631 (see also U.S. Pat. No. 4,278,892), it is frequently advantageous to provide at least one bore in the wall of the vessel, extending from the upper end thereof to open into the interior of the vessel close to the bottom, which serves to feed material into or draw material from the interior of the vessel and/or for control or monitoring purposes.

In earlier arrangements utilizing such a bore, the latter terminated at the upper end of the vessel outwardly of the outline of the radiation-shielding or plug-type cover and required special closures. This, in turn, made sealing difficult and complicated the problem of controlling the storage of the radiation material by making access to the material through the bore considerably more difficult.

OBJECTS OF THE INVENTION

It is the principal object of the present invention to provide an improved storage and transport container for radioactive materials which is free from the disadvantages described.

Another object of the invention is to provide an improved container which extends the principles of our U.S. Pat. Nos. 4,274,007 and 4,278,892 mentioned above.

It is also an object of the invention to provide a radiation-shielding transport and/or storage container which facilitates control and monitoring of the state of the contents of the vessel.

A further object of the invention is the provision of an improved cover structure for a vessel to be utilized for the aforedescribed purposes.

SUMMARY OF THE INVENTION

These objects and others are attained, in accordance with the present invention, in a transport and/or storage container adapted to receive radioactive materials and in which the wall bore of the vessel terminates at the upper end and within the outline of the shielding or plug-type cover and preferably within the outline of the plug portion thereof, while this cover is formed with a bore adapted to be aligned with the wall bore and in which an obturating element (e.g. a valve or plug) can be fitted to extend into the wall bore and seal the latter, the bore of the cover being covered in turn by an additional or safety cover.

In other words, when a plurality of wall bores are provided in the vessel of cast iron, each of them open in the region of the seat into which the plug-forming radiation-shielding cover fits to be aligned with corresponding bores in this cover.

In this manner, the shielding cover can be formed in the region of the seat or socket with control, monitoring and test bores in which control or monitoring devices, fittings, valves or the like can be inserted so that these devices, if left in place, or the control or test bores can be covered by the outer of second cover.

The number and type of control and test bores will depend upon the test required during transport and storage of the container as well as upon special purposes to which the container may be put and may be determined by a control or monitoring program, by regulation or by statute.

Preferably, the additional cover does not sit directly upon the edge of the vessel but rather is recessed therein, i.e. fits into a recess forming a seat for this cover and provided in the mouth-forming end of the vessel so that the outer cover does not project beyond the vessel wall but is either recessed inwardly from this end of the vessel or is flush therewith. Naturally the vessel can be formed with a shoulder or seat against which the additional cover is sealingly set.

It is possible to provide still further covers as described, for example, in our concurrently filed copending application Ser. No. 243,562 (now U.S. Pat. No. 4,450,042), for greater security or to facilitate monitoring the seals of the covers by monitoring a control gas which can be introduced into the vessel with the radioactive material as described in the latter application.

The reinforcing bead or thickened end of the mouth of the vessel permits the system of the invention to be accommodated economically and without loss of radiation-shielding effect.

BRIEF DESCRIPTION OF THE DRAWING

The above and other objects, features and advantages of the present invention will become more readily apparent from the following description, reference being made to the accompanying drawing in which.

SPECIFIC DESCRIPTION

The transport and storage container for radioactive wastes in accordance with the present invention is composed of cast iron and especially spherulitic or nodular cast iron and is adapted to receive irradiated nuclear elements and similar radioactive materials.

Figure 1:
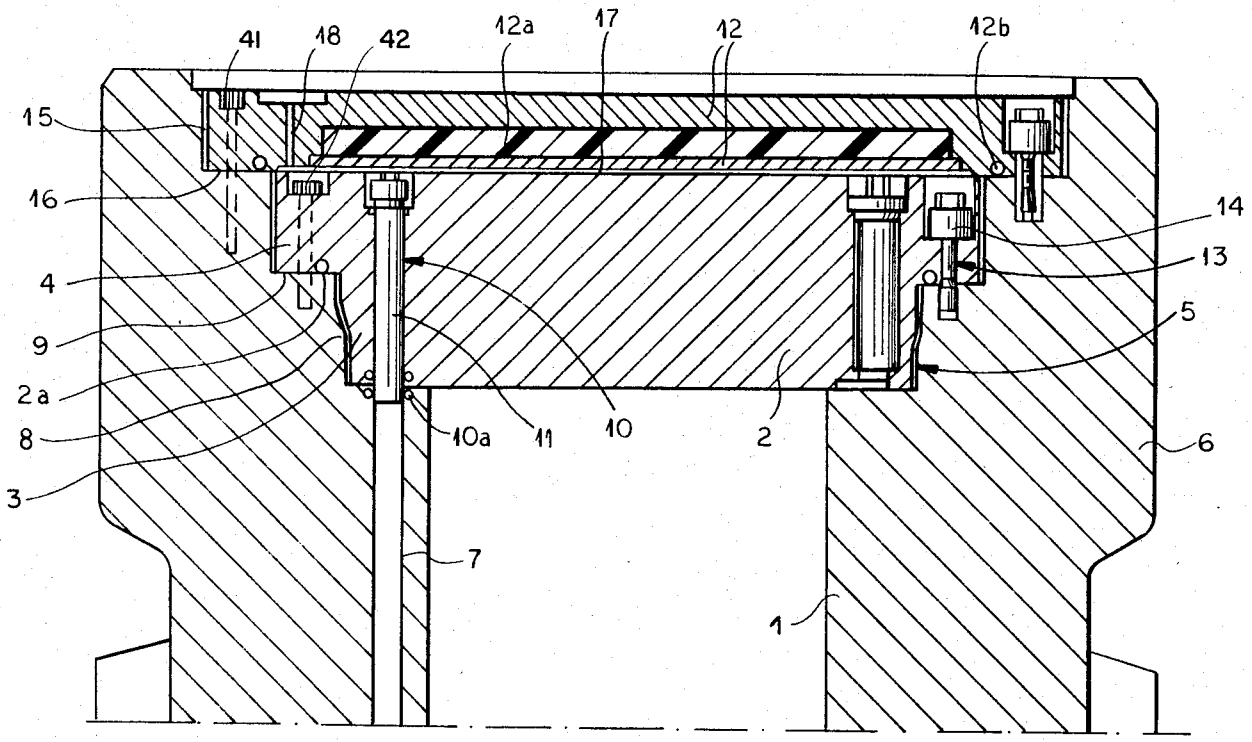
FIG. 1 is an axial cross-sectional view through the mouth of a container according to the invention.
Figure 2:
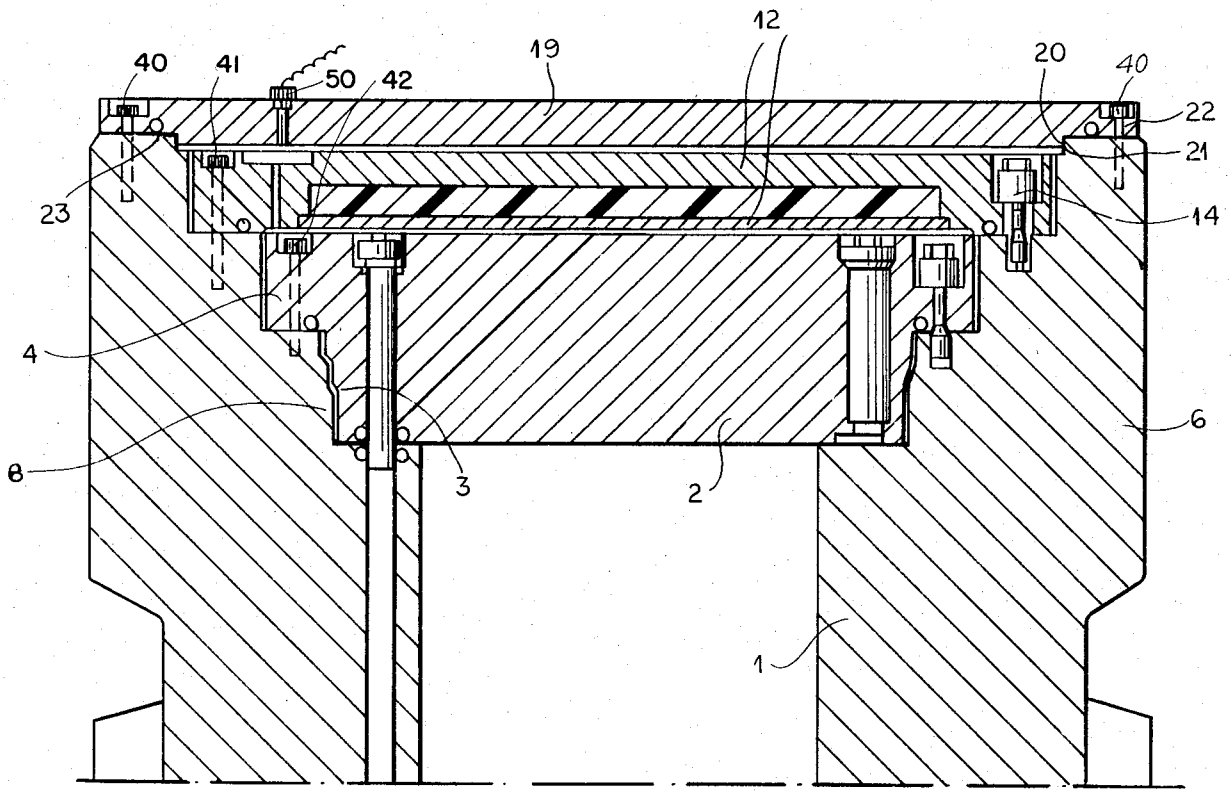
FIG. 2 is a view of this structure illustrating an outer or control cover in place therein.
Figure 3:
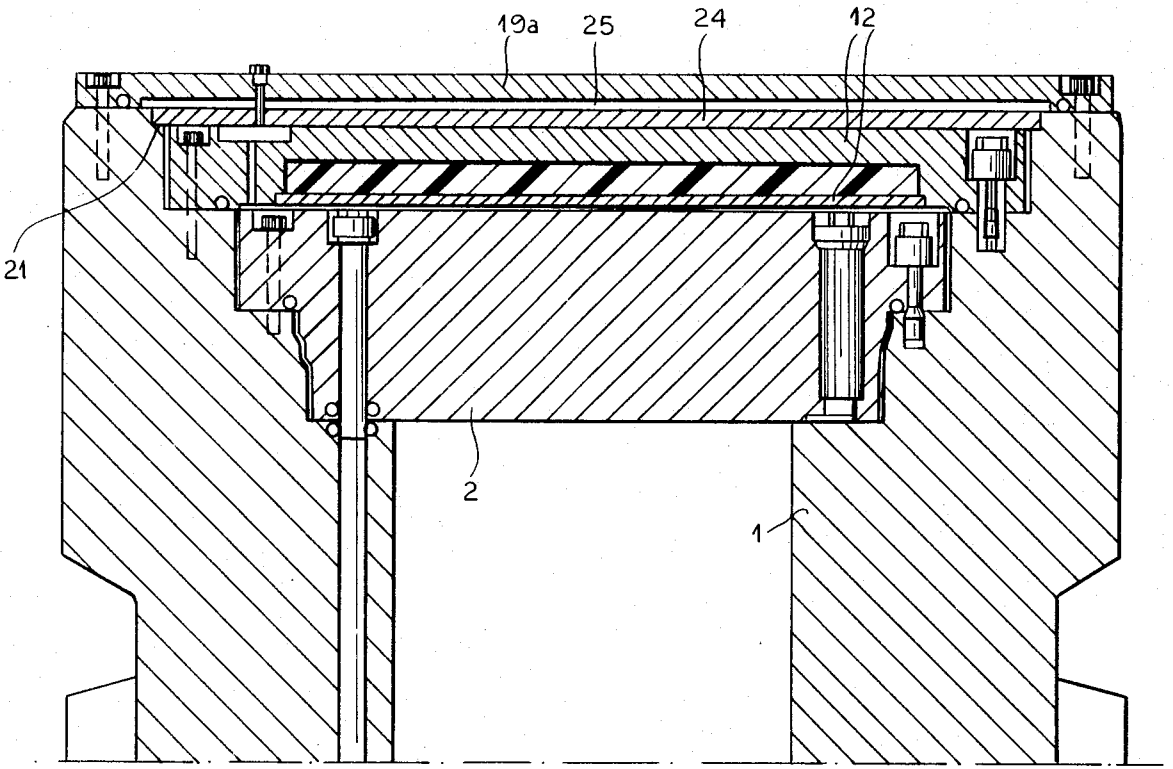
FIG. 3 illustrates yet another embodiment of the invention having an additional barrier cover member.

Basically it comprises a radiation-shielding vessel 1, the upper end of the wall of which has been made in FIGS. 1 through 3 and which can be of the construction described in the aforementioned copending applications, especially application Ser. No. 966,951, (U.S. Pat. No. 4,278,892) apart from the orientation of the wall bore thereof.

The vessel has a closed bottom, not shown, which can be of greater wall thickness, i.e. provided with a thickened portion similar to the thickened portion 6 surrounding the mouth of vessel 1.

The mouth of the vessel 1 receives a radiation-shielding or plug-type cover 2 which is of sufficient thickness that escape of radiation through the cover is precluded just as the wall thickness of the vessel and the material from which it is composed or the material which is included therein are selected with respect to the energy of the radioactive emissions from the stored material as to preclude release of radiation.

The cover 2 is formed with a plug-type fitting portion 3 and with a flange 4 which are received in a complimentarily-shaped seat 5. At least one additional cover is provided as will be developed below.

The wall 1 is formed in the region of the seat 5 and thus the region of the reinforcement bead 6 and within the outline of the shielding cover 2 with the outlet end of a wall bore 7 which can extend to the bottom of the vessel to communicate with the interior thereof (see Ser. No. 966,951—U.S. Pat. No. 4,278,882).

While only one such wall bore 7 has been illustrated, it will be understood that a number of such bores can be provided for introducing the radioactive material into the vessel 1, for discharging radioactive material from the vessel, for introducing a control gas, or for monitoring the vessel contents as may be required by law or for safety in the storage or transportion of radioactive material in the vessel.

The seat 5 is shown to comprise a wall portion 8 which is complimentary to and sealingly cooperates with the periphery of the cylindrical and/or frustoconical plug portion 3 and is adapted to receive the latter. The bore 7 terminates inwardly of this surface 8 at a shoulder extending perpendicular to the axis of the vessel. A further shoulder 9 receives the flange 4 of the shielding cover 2.

The shielding cover 2 is provided with a respective bore 10 for each wall bore 7, the bores 10 serving as connecting bores in which valves or plugs 11 (obturating elements) can be inserted and which can be covered by an additional cover 12.

The shielding cover 2 is additionally provided in the region of the seat 5 with control, monitoring or test bores 13 which can receive valves, pressure-monitoring devices, gas analyzers or sample units of any conventional type as represented at 14. These control bores 13 are also covered by the outer cover 12 and lie within the outline thereof.

The outer cover 12 itself is received in a recess 15 formed in the open end of the vessel 4 against a shoulder 16.

In the embodiment of FIG. 1 the additional cover 12 is formed as a control cover which allows the shielding function of the cover 2 to be monitored. To this end, the cover 12 can define a control compartment 17 with the cover 2 and can be provided with a bore 18 to which a monitoring unit can be attached to communicate with the compartment 17 and determine the leakage of control gas into the latter or the accumulation of radioactive species therein.

It is in this form generally that the container, after being loaded, is temporarily stored in or is transported from a nuclear power plant in which the stored radioactive materials were produced.

For longer-term storage and more rigorous protection during transportation a further cover 19 can be applied as is shown in FIG. 2. The cover 19 has a plug portion 20 which fits snugly in a recess 21 and a flange 22 which rests upon the upper edge 23 of the vessel 1.

While bolts 40, 41, 42 are shown to fix the covers in place in FIGS. 1 through 3, welded lip seals can also be used alone or in combination with bolts (see application Ser. No. 966,951—U.S. Pat. No. 4,278,892 or Ser. No. 243,562, now U.S. Pat. No. 4,450,042.

The cover 2 can be provided with seals as described in the last mentioned application and thus forms a first barrier which, by monitoring of compartment 17 through the cover 12, can be controlled to determine the security of the first level of sealing action.

Since the cover 19 forms a gap with the cover 12, this gap can constitute a second compartment which is sealed by the cover 19 but which can be monitored.

In still another embodiment of the invention shown in FIG. 3, the outer cover can be doubled so that two sealed barriers are provided.

In this case, a barrier cover 24 is provided directly above the cover 12 and is welded to the upper end of the vessel 1 in the recess 21 while the outer cover 19*a*, which can be bolted or welded in place as well with appropriate seals, defines a control cover forming a compartment 25 which can be monitored, e.g. by a sampler 50, in the manner described.

As a comparison of FIGS. 2 and 3 will show, the cover arrangements of these two FIGS. can be used interchangeably.

The bores 10 can serve to force (pump) radioactive material into the vessels or to evacuate fluid from the vessel after material has been introduced therein, or to receive a sampling lance. The bore 10 of the confronting portion of bore 7 can be provided with O-ring seals 10*a* which can be omitted when an immersion-type lance is based through the aligned bores 7 and 10. The cover 12 can be formed with a radiation-attenuating material 12*a* akin to that which may be provided in channels in the wall 1 (see the aforementioned applications) and metal and/or elastomeric O-rings 2*a* and 2*b* may be provided as additional seals.

We claim:

1. A container for the storage and transportation and radioactive material comprising:

an elongated vessel receiving said material and having a wall thickness and composition attenuating radioactive transmission therefrom, said vessel having an open end formed with an annular thickened portion defining a mouth communicating with the interior of said vessel;

a radiation-shielding cover received in said mouth and having a plug-forming portion juxtaposed with a complementary seat-forming portion of said vessel at said mouth, and a flange extending outwardly from said plug-forming portion, said vessel being provided with a wall bore communicating at one end with the interior of said vessel and open at its opposite end, said radiation-shielding cover extending outwardly beyond said wall bore, said radiation-shielding cover being provided with a connecting bore registering with said wall bore;

an obturating element received in said connecting bore and adapted to block said wall bore;

a further cover secured directly to said vessel outwardly of said radiation-shielding cover and overlying said wall bore and said radiation-shielding cover, said radiation-shielding cover being formed with at least one control bore in the region of said seat-forming portion and covered by said further cover, said further cover defining with said radiation-shielding cover a control compartment into which said control bore and said connecting bore open and provided with means whereby the sealing effectiveness of said radiation-shielding cover can be monitored; said vessel being provided with a recess, said further cover being received in said recess against a shoulder formed by said vessel outwardly of said radiation-shielding cover; and another cover lying outwardly of said further cover and at least partly received in said recess.

2. The container defined in claim 1 wherein said other cover defines a second control compartment with said further cover whereby leakage from the interior of said vessel can be monitored.

3. The container defined in claim 1 wherein a control cover is secured to said vessel above said other cover and defines a second control compartment therewith whereby leakage from the interior of said vessel can be monitored.

4. The container defined in claim 1, claim 2 or claim 3 wherein said wall bore opens at said other end at said seat-forming portion.

* * * * *